US005362946A

United States Patent [19]

Matsushima

[11] Patent Number: 5,362,946

[45] Date of Patent: Nov. 8, 1994

[54] COOKING APPLIANCE THAT PREVENTS INITIATION OF COOKING CYCLE AFTER PREDETERMINED TIME ELAPSES AFTER DOOR CLOSURE

[75] Inventor: Kazufumi Matsushima, Aichi, Japan

[73] Assignee: Kabushiki Kaisha Toshiba, Kawasaki, Japan

[21] Appl. No.: 59,564

[22] Filed: May 12, 1993

[30] Foreign Application Priority Data

May 29, 1992 [JP] Japan ..... 4-138560

[51] Int. Cl.[5] ..... H05B 6/68

[52] U.S. Cl. ..... 219/704; 219/492; 219/719; 219/721; 219/723; 99/325

[58] Field of Search ..... 219/10.55 B, 10.55 C, 219/10.55 R, 10.55 E, 518, 492, 704, 706, 719, 721, 723; 99/325

[56] References Cited

U.S. PATENT DOCUMENTS

| | | | |
|---|---|---|---|
| 4,166,137 | 8/1979 | Buck | 219/10.55 M |
| 4,425,490 | 1/1984 | Takeda et al. | 219/10.55 B |
| 4,471,195 | 9/1984 | Ishii et al. | 219/10.55 E |
| 4,533,810 | 8/1985 | Harmon et al. | 219/10.55 B |
| 4,539,453 | 9/1985 | Miyazaki et al. | 219/10.55 C |

FOREIGN PATENT DOCUMENTS 410389 1/1992 Japan .

*Primary Examiner*—Philip H. Leung
*Attorney, Agent, or Firm*—Cushman, Darby & Cushman

[57] ABSTRACT

A cooking appliance has several sensors to detect which attachment has been placed in a cooking compartment. When a door to the compartment is closed and a start switch is operated within ten seconds, the appliance automatically starts cooking in a mode determined by the attachment detected by the sensors. After the door has been closed for ten seconds, even though the start switch is operated by accident, the appliance will not start cooking.

11 Claims, 6 Drawing Sheets

FIG. 2.
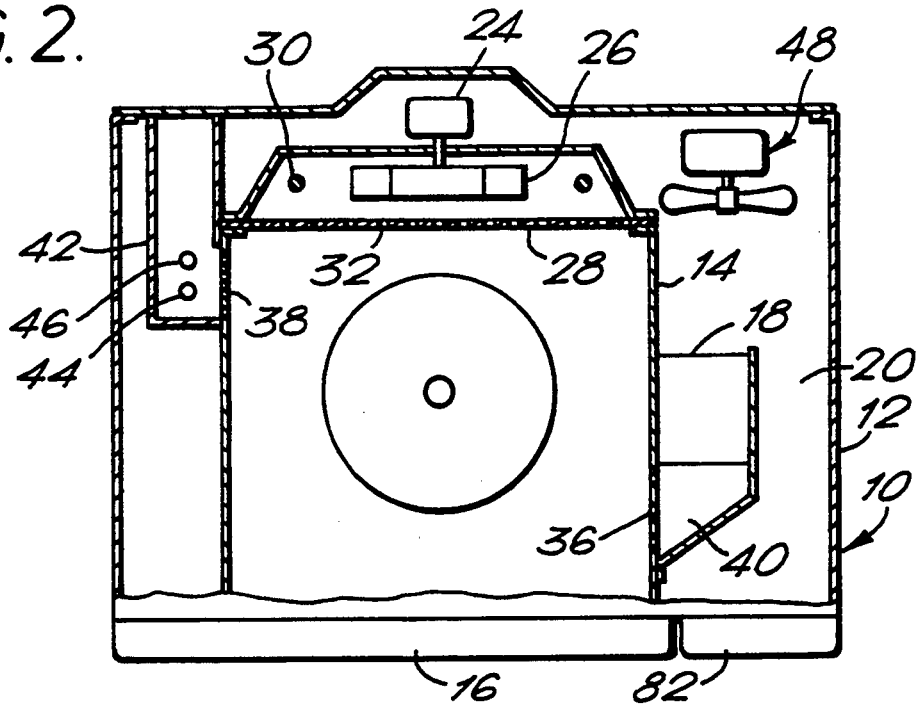
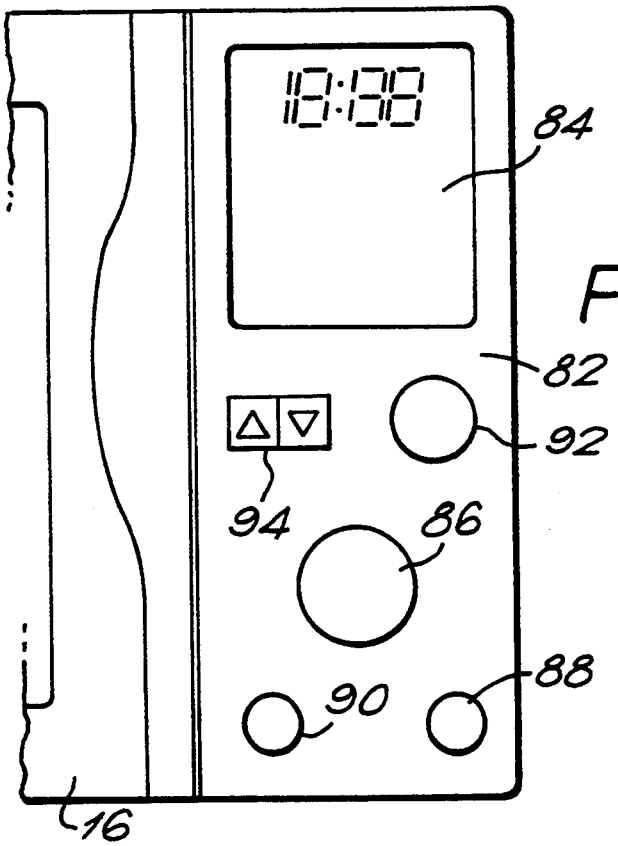
FIG. 4.

COOKING APPLIANCE THAT PREVENTS INITIATION OF COOKING CYCLE AFTER PREDETERMINED TIME ELAPSES AFTER DOOR CLOSURE

BACKGROUND OF THE INVENTION

The present invention relates to a cooking appliance and method, which automatically sets a cooking mode based on attachments an operator may choose to use in a cooking compartment. When a start switch is operated, the cooking appliance automatically cooks food in a cooking mode as automatically set.

A prior cooking appliance, such as a microwave oven with a magnetron, an oven heater, and a grill heater, has a plurality of cooking modes. Such a cooking appliance is disclosed, for example, in Japanese laid-open Patent Application 4-10389. The cooking modes include microwave cooking using the magnetron, oven cooking using the oven heater, so that temperature in the cooking compartment is increased and the food is cooked, and grilling using the grill heater, so that the food is cooked by the radiation of the grill heater. The multi-mode microwave oven uses different attachments depending on the cooking mode selected. The microwave oven has a detection system by which any attachment placed in the cooking compartment is detected. When a door of the microwave oven is closed, the microwave oven detects such attachments. The microwave oven automatically sets the cooking mode based on the detected attachments. When a user operates a start switch, the microwave oven automatically cooks the food based on the set cooking mode.

Once the cooking mode is set, that mode remains until a new cooking mode is set. Therefore, even though a user touches the start switch only by accident long after the door is closed, the microwave oven starts cooking based on the once set cooking mode. When a user temporarily places food or anything else in the cooking compartment which the user does not want cooked, an accident can occur.

In the automatic microwave oven, all a user has to do is press the start switch. As a result, although operation becomes very easy, undesired operation also occurs easily.

SUMMARY OF THE INVENTION

It is an object of the present invention to provide a cooking appliance and method in which undesired operation can be minimized.

In order to achieve the above object, in the method and apparatus of the present invention, a cooking compartment is provided for receiving food and various attachments. A door enables access to the cooking compartment. Heating means heats food received in the cooking compartment. Not only whether the door is open or closed, but also the presence of any attachments in the cooking compartment is detected. In response to the detection, a desired cooking mode is set based on the attachments in the cooking when the door is closed. The set cooking mode is cancelled, and therefore cooking cannot occur, after a predetermined time has elapsed from closure of the door without a start command being given.

BRIEF DESCRIPTION OF THE DRAWINGS

There and other objects and advantages of this invention will become apparent and more readily appreciated from the following description of the presently preferred exemplary embodiment, taken in conjunction with the accompanying drawings, of which:

FIG. 2 is a cross section of the cooking appliance;

FIG. 4 is a front view of an operation panel of the cooking appliance;

DETAILED DESCRIPTION OF THE PRESENTLY PREFERRED EXEMPLARY EMBODIMENT

Figure 1:
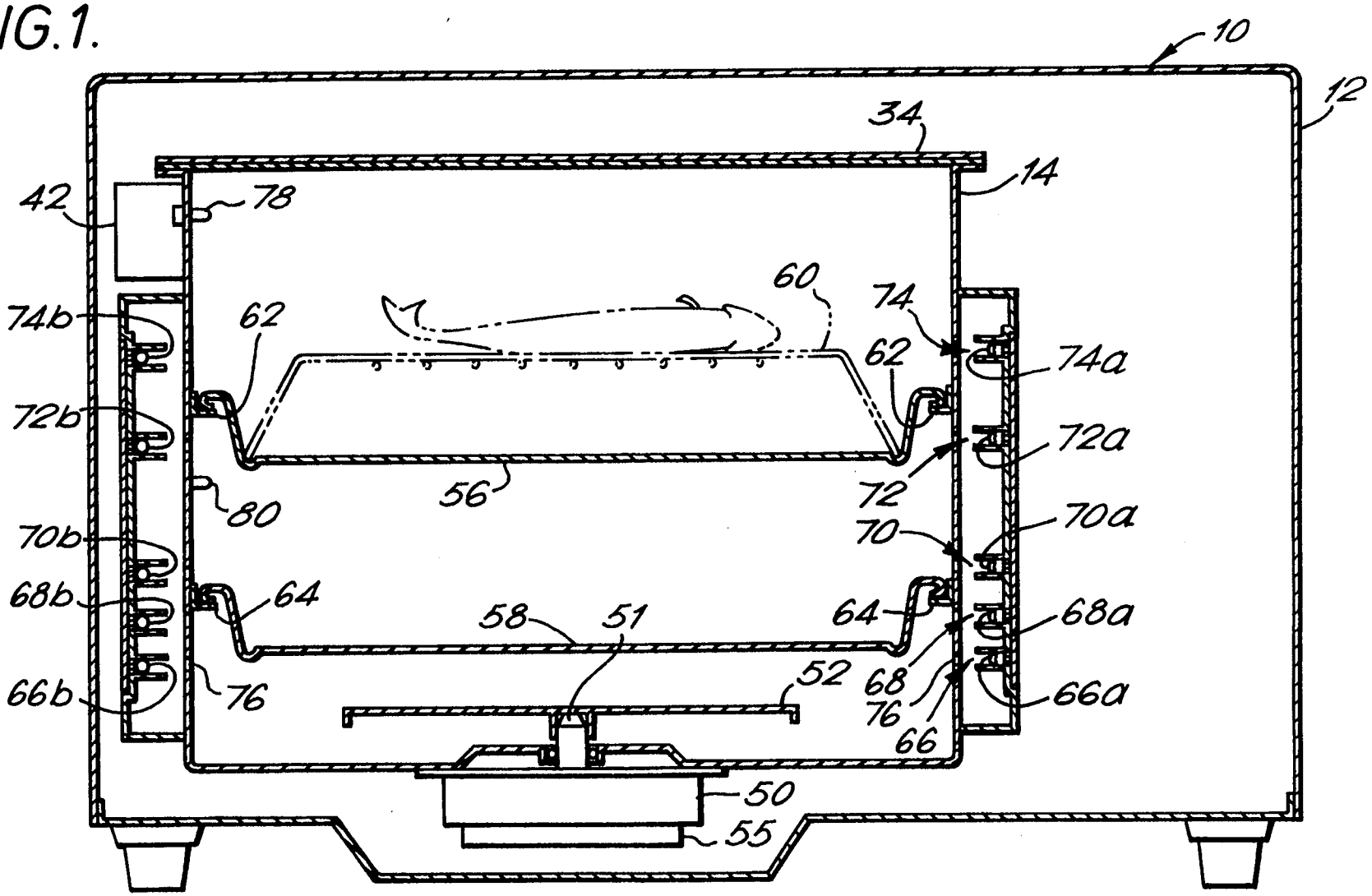
FIG. 1 is a vertical section of a cooking appliance according to the present invention.

An embodiment, in which the present invention is employed in a microwave oven with heaters, will now be described. As illustrated in FIG. 1, a microwave oven 10 comprises an outer case 12 and a cooking compartment 14. A door 16 (see FIG. 2) is pivotally mounted in front of cooking compartment 14 to open and close cooking compartment 14. A magnetron 18, which heats food in cooking compartment 14, is located in a machinery housing 20 between outer case 12 and cooking compartment 14. Magnetron 18 is connected to cooking compartment 14 through a waveguide.

A motor 24 which rotates a fan 26 is located behind a rear wall 28 of cooking compartment 14. An oven heater 30, which is used in oven cooking, is positioned around fan 26. Rear wall 28 has plural holes 32, through which air is circulated due to the rotation of fan 26. A grill heater 34 is attached on a ceiling wall of cooking compartment 14.

Cooking compartment 14 has an air inlet 36 and an air outlet 38. An inlet duct 40 is provided between magnetron 18 and air inlet 36. An outlet duct 42 is provided between outer case 12 and air outlet 38. A steam sensor 44 and an alcohol sensor 46 are located in outlet duct 42. A cooling fan 48 is provided in machinery housing 20 to cool magnetron 18. When cooling fan 48 rotates, outside air is drawn in machinery housing 20. The air flows into cooking compartment 14 through inlet duct 40 after it cools magnetron 18. The air with steam and alcohol inside cooking compartment 14 flows to outlet duct 42 through an air outlet 38. Steam sensor 44 and alcohol sensor 46 detect steam and alcohol, after that the air is exhausted to the outside.

A table motor 50, which is provided on a bottom of cooking compartment 14, rotates a detachable turntable 52 about a shaft 51. A weight sensor 55 can measure the weight of something placed on turntable 52. When magnetron 18 is used, turntable 52 rotates with an attachment thereon.

Figure 3:
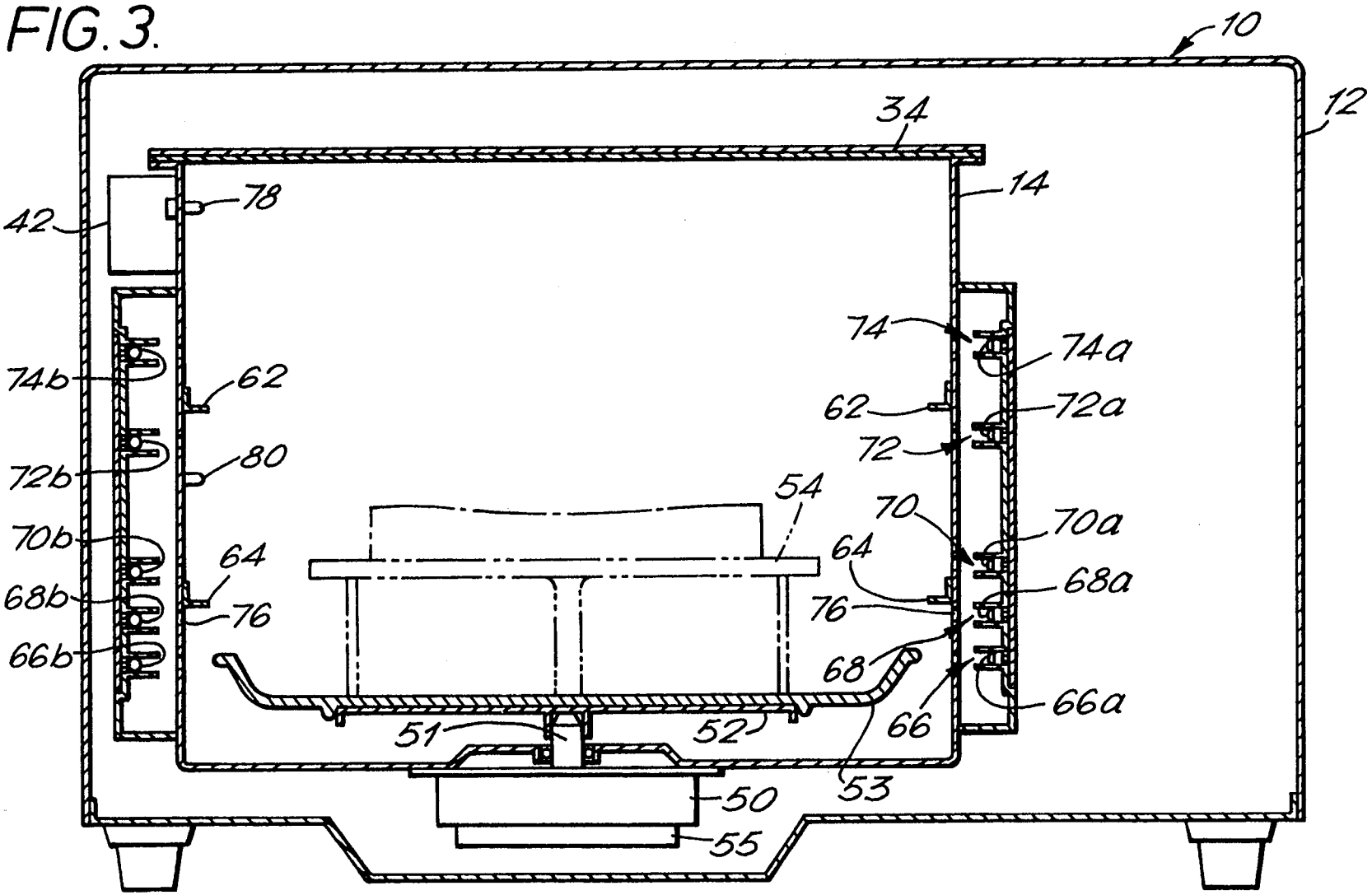
FIG. 3 is a vertical section of the cooking appliance.

One or more of several different attachments, selected based upon the desired cooking mode, may be positioned in cooking compartment 14. Each attachment will now be described. When microwave cooking, a glass plate 53, as shown in FIG. 3, is used when heating and cooking. Both a plastic thawing rack 54 and the glass plate are used when thawing. Boiled rice, side dishes, milk, etc., to be warmed are placed in containers put on glass plate 53. When thawing, thawing rack 54 is placed on glass plate 53. Then the food to be thawed is placed on thawing rack 54.

When oven cooking or grill cooking, metal baking trays 56 and 58 and/or a grill rack 60 are used, as shown in FIG. 1. Upper baking tray 56 and lower baking tray 58 are of the same construction, in the shape of a shallow square dish. Baking trays 56 and 58 can be placed on top supports 62 and bottom supports 64 on side walls of cooking compartment 14, respectively.

When oven cooking, at least one baking tray 56 or 58 is used. When grilling, grill rack 60 is always used only with upper baking tray 56 to position food close to grill heater 34. Grill rack 60 is positioned on upper baking tray 56, and the food is positioned on grill rack 60. When oven cooking and when grill cooking, glass plate 53 is removed from cooking compartment 14.

Five pairs of transmission type photosensors 66 to 74 comprise light projectors such as infrared irradiation light emitting diodes **66*a* to 74*a* and photoceptors such as photodiodes 66*b* to 74*b*. Photosensors 66 to 74 are positioned on the exterior of the side wall of cooking compartment 14. The side wall of cooking has five pairs of holes 76 in accordance with light projectors 66*a* to 74*a* and photoceptors 66*b* to 74*b*. Photosensors 66 to 74 can detect attachments in cooking compartment 14 through holes 76. The first photosensor 66, which is located at the lowest position, can detect whether glass plate 53 is positioned in turntable 52. The second photosensor 68, which is located at the second lowest position, can detect whether lower tray 58 is hung on bottom supports 64. The third photosensor 70, which is located at the middle position, can detect whether thawing rack 54 is positioned on glass plate 53. The fourth photosensor 72, which is located at the second highest position, can detect whether upper tray 56 is hung on top supports 62. The fifth photosensor 74, which is located at the highest position, can detect whether grill rack 60 is on upper tray 56**.

As shown in FIG. 3, when glass plate 53 is on turntable 52, first photoceptor **66*b* cannot receive light which is emitted by first light projector 66*a*, because glass plate 53 interrupts the light. When thawing rack 54 is on glass plate 53 in the thawing mode, third photoceptor 70*b* cannot receive light which is emitted by third light projector 70*a* as well, because thawing rack 54** interrupts the light.

As a result, the oven determines that the attachment in compartment 14 is glass plate 53 on the basis of the data from photoceptors **66*b* to 74*b* when only first photoceptor 66*b* does not receive light. The attachment is determined to be thawing rack 54 when only first and third photoceptors 66*b* and 70*b*** do not receive light.

When both upper tray 56 and lower tray 58 are hung on supports 62 and 64 or when lower tray 58 is hung on bottom support 64, for oven cooking, lower tray 58 interrupts the light emitted from second light projector **68*a*, and upper tray 56 interrupts the light emitted from fourth light projector 72*a*. As a result, the oven determines that oven cooking is the correct mode when one or both of second photoreceptor 68*b* and fourth photoreceptor 72*b*** do not receive light.

When both upper tray 56 and grill rack 60 are installed in cooking compartment 14 for grilling, upper tray 56 interrupts the light emitted from fourth light projector **68*a*, and grill rack 60 interrupts the light emitted from fifth light projection 74*a*. As a result, when grilling, both fourth photoreceptor 72*b* and fifth photoceptor 74*b*** do not receive light.

Therefore, it can be seen from the above that photoceptors **66*b* to 74*b* can be used to determine which attachments are in cooking compartment 14. The determination as to which attachments are present is made while turntable 52** rotates. The reasons are as follows.

When glass plate 53 is used for cooking, and a container on glass plate 53 is higher than the position of third photosensor 70, the container interrupts the light emitted from third light projector **70*a*. Since both first and third photoceptors 66*b* and 70*b* do not receive light, it is difficult to distinguish between the container and thawing rack 54. To prevent the above problem, when the food is heated by microwave using magnetron 18, the user carefully places the food container away from the center of glass plate 53. In this embodiment, the light path from first and third photosensors 66 and 70 is set so that it passes over the center of turntable 52. While the determination concerning attachments is being made, turntable 52 rotates with glass plate 53 and the container or thawing rack 54 which are put on the glass plate. As a result, a higher container intermittently interrupts the light emitted from third light projector 70*a*, a lower container does not interrupt the light, and thawing rack 54 continuously interrupts the light. Therefore, distinguishing between the high containers and thawing 54** is possible.

Weight sensor 55 is an electrostatic capacitance sensor, which has a movable electrode plate and a static electrode plate confronting each other. The movable electrode supports shaft 51 of table motor 50. When shaft 51 goes down in response to the weight of food placed on glass plate 53, the distance between the movable electrode plate and the static electrode plate becomes narrow. As a result, the electrostatic capacitance between the plates, corresponding to the distance, indicates the weight of food put on glass plate 53 or thawing rack 54.

An oven temperature sensor 78, which is located on the side wall of cooking compartment 14, detects the temperature of the upper portion within the cooking compartment. A grill temperature sensor 80, which is located on the side wall of cooking compartment 14 and near top support 62, detects the temperature under upper tray 56.

FIG. 4 shows an operation panel 82 which is provided in front of machinery housing 20. Operation panel 82 has a display 84, a start switch 86, and a cancel switch 88 to stop cooking. A select switch 90, located on operation panel 82, allows a user to select either a manual mode or an automatic mode. The user can set a time using a time setting dial 92 and set a cooking temperature using a temperature setter 94 in the manual mode.

Figure 5:
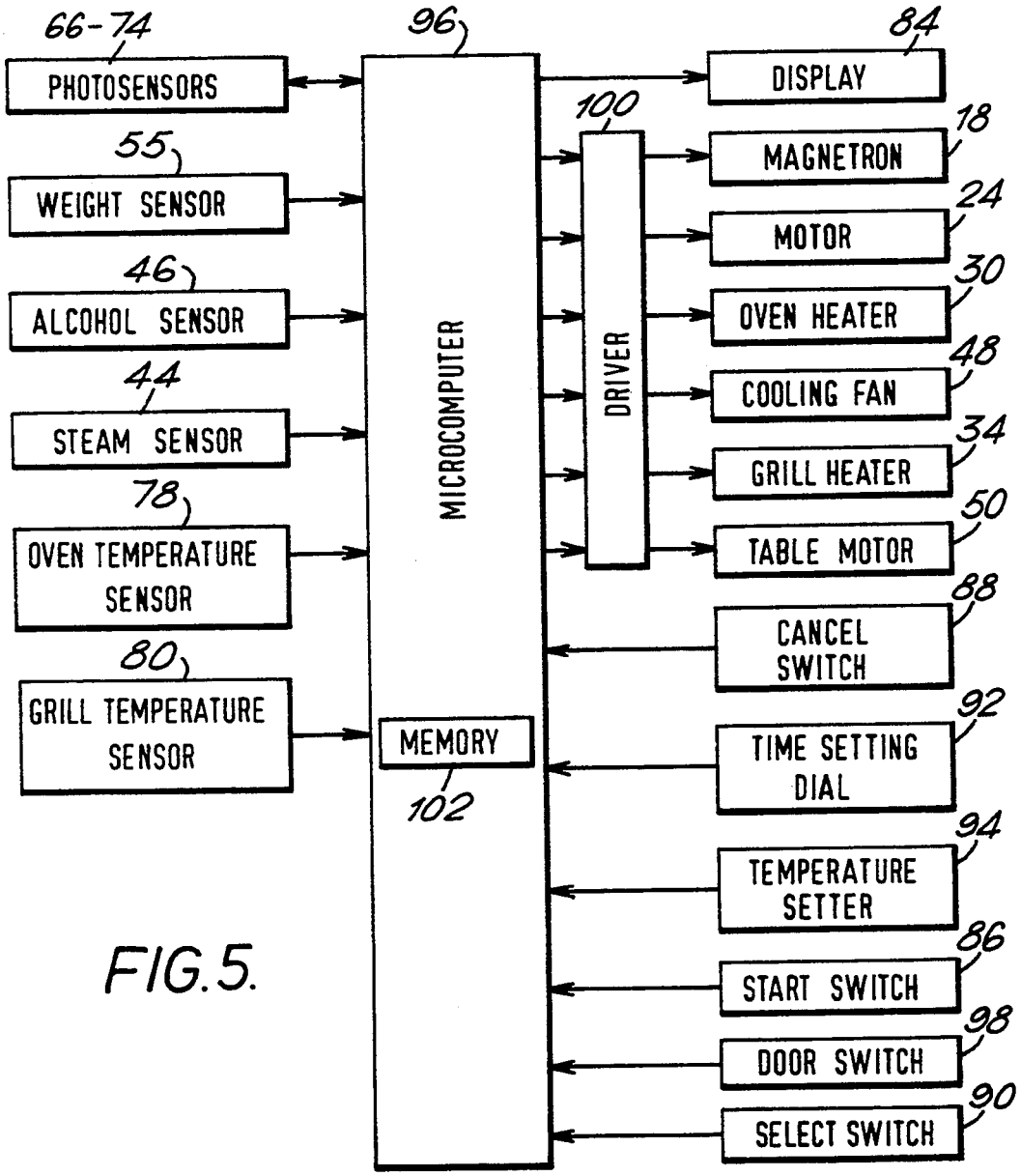
FIG. 5 is a block diagram showing an electrical arrangement of the cooking appliance.

FIG. 5 illustrates the electrical arrangement of the oven. Photosensors 66 to 74 are connected to a microcomputer 96, light projectors **66*a* to 74*a* are controlled by the microcomputer, and signals from photoceptors 66*b* to 74*b* are input to the microcomputer. Also, weight sensor 55, steam sensor 46, alcohol sensor 46, and temperature sensors 78 and 80 are connected to microcomputer 96, and signals from them are input to the microcomputer. Signals from start switch 86, cancel switch 88, select switch 90, time setting dial 92, and temperature setter 94 are input to microcomputer 96. A door switch 98, including a microswitch which is activated in accordance with the opening or closing of door 16, is connected to microcomputer 96. Microcomputer 96 controls display 84 directly and magnetron 18, cooling fan 48, oven heater 30, motor 24, grill heater 34, and table motor 50 through a driver 100 on the basis of input signals and a program stored in a memory 102**.

When microcomputer 96 detects that door 16 is closed by means of the signal from door switch 98, the microcomputer distinguishes which of the attachments are in cooking compartment 14 on the basis of the signals from photoceptors **66*b* to 74*b*. Microcomputer 96 determines and sets the cooking mode, i.e., either microwave cooking, oven cooking, or grilling based on this determination. Therefore, microcomputer 96 detects attachments in compartment 14**, as well as sets the cooking mode.

When microcomputer 96 detects that door 16 is closed, the microcomputer enters a standby mode. During the standby mode, when start switch 86 is pressed, microwave oven 10 automatically starts cooking based on the cooking mode determined to be appropriate. After automatic cooking has begun, microcomputer 96 controls cooking based on information detected by steam sensor 44 and alcohol sensor 46.

For example, in the oven cooking or grilling mode, microcomputer 96 determines the type of food based being cooked based on the quantity of steam and/or alcohol at the beginning of the cooking process, and sets the cooking temperature and time based on the above determination. Microcomputer 96 controls oven heater 30 and grill heater 34 based on the temperature detected by oven temperature sensor 78 or grill temperature sensor 80 so that the set temperature is maintained. Similarly, in the microwave cooking mode, microcomputer 96 determines the type of food being cooked based on the quantity of steam and/or alcohol. Microcomputer 96 sets the power of magnetron 18 and a cooking time based on the above determinations, information from weight sensor 55, and changes in the quantity of steam, etc.

Figure 6:
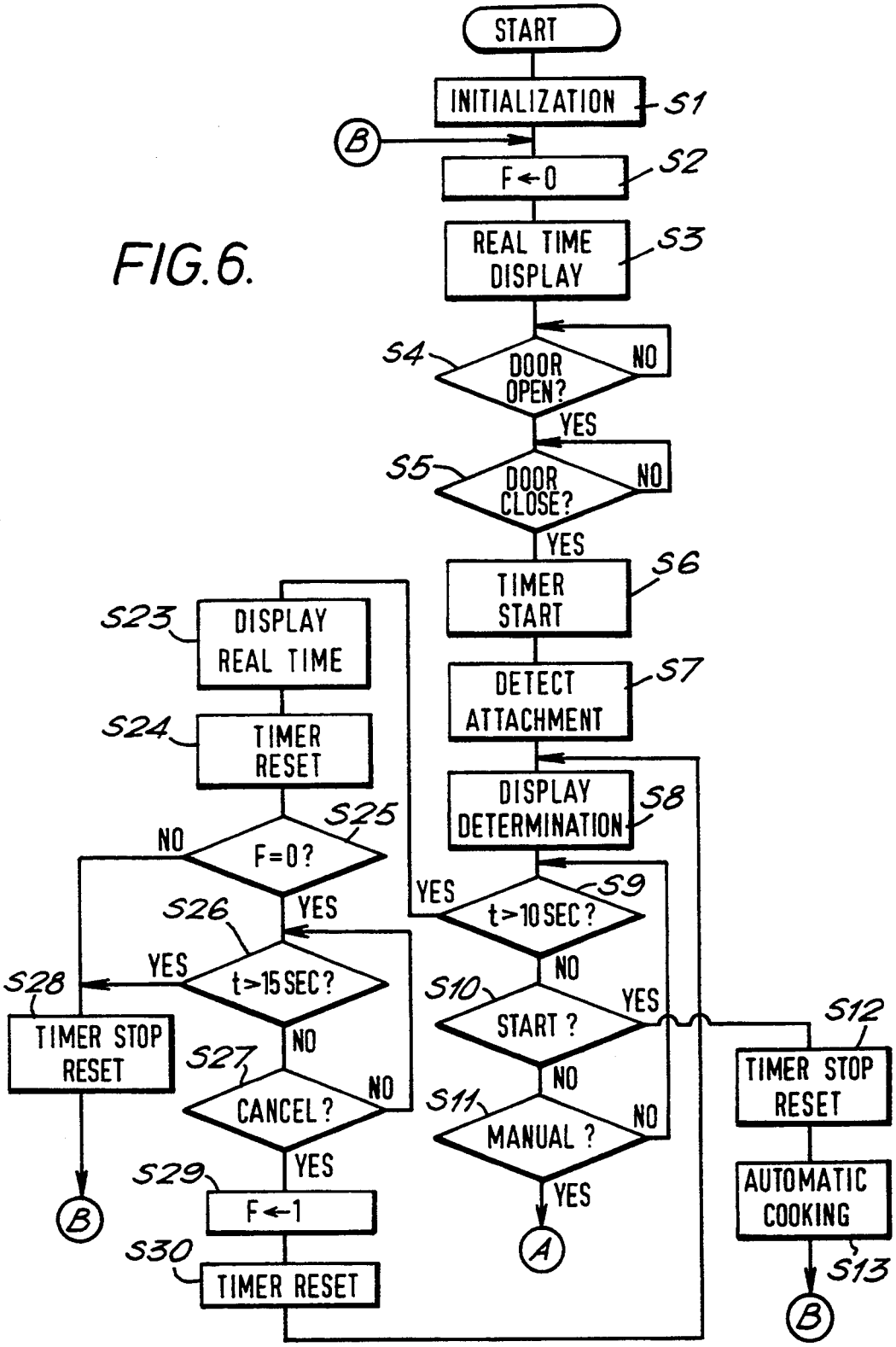
FIG. 6 and 7 are flow charts showing operation of the cooking appliance.

Operation of this embodiment will be described with reference to the flowchart of FIGS. 6 and 7. When power is supplied to microwave oven 10, microcomputer 96 performs an initialization (step S1), and sets a flag F to "0" (step S2). Display 84 displays the real time (step S3). Microcomputer 96 determines whether door 16 is opened based on the signal from door switch 98 (step S4). If the door is closed, step S4 is repeated until the door opens. Once the door is opened, microcomputer 96 then waits for door 16 to close (step S5). When a user wants to cook food, the user places an appropriate attachment in compartment 14 and food on the attachment. When this occurs, a timer starts counting (step S6). Microcomputer 96 determines which attachments are in cooking compartment 14 based on the information from photosensors 66 to 74, and sets the cooking mode according to the determination (step S7). Microcomputer 96 changes the display from the actual time to indicate the type of attachment in compartment 14 and the words "automatic cooking" (step S8).

Microcomputer 96 next determines whether the count of the timer has exceeded 10 seconds (step S9). If not, and start switch 86 is pressed (step S10), the timer stops counting and is reset to "0" (step S12). The microwave oven 10 automatically starts cooking (step S12). After the cooking is finished, flow returns back to step S2.

When step S10 determines that start switch 86 has not been pressed, microcomputer 96 determines whether select switch 90 is pressed, that is, whether manual cooking is selected (step S11). If not, flow returns back to step S9.

If, at step S9, it is ever determined that the timer has counted over 10 seconds, display 84 displays the actual time again instead of the type of attachment and "automatic cooking" (step S23). The count of the timer is reset and cleared (step S24). Microcomputer 96 determines whether flag F is "0" (step S25). If it has been set, microcomputer 96 determines whether the count of the timer has exceeded an additional 15 seconds (step S26). If not, and cancel switch 88 has not pressed in step S27, flow returns back to step S26. If step S27 determines that cancel switch 88 has been pressed, the flag F is set to "1" (step S29) and the count of the timer is reset and cleared (step S30). Flow returns to step S8.

If the count of the timer exceeds an additional 15 seconds at step S26, the timer is reset and stops counting (step S28), and flow returns back to step S2. When the flag F is not "0," that is, after the flag F is set to "1" at step S29, flow enters step S25 again and progresses to step S28.

Figure 7:
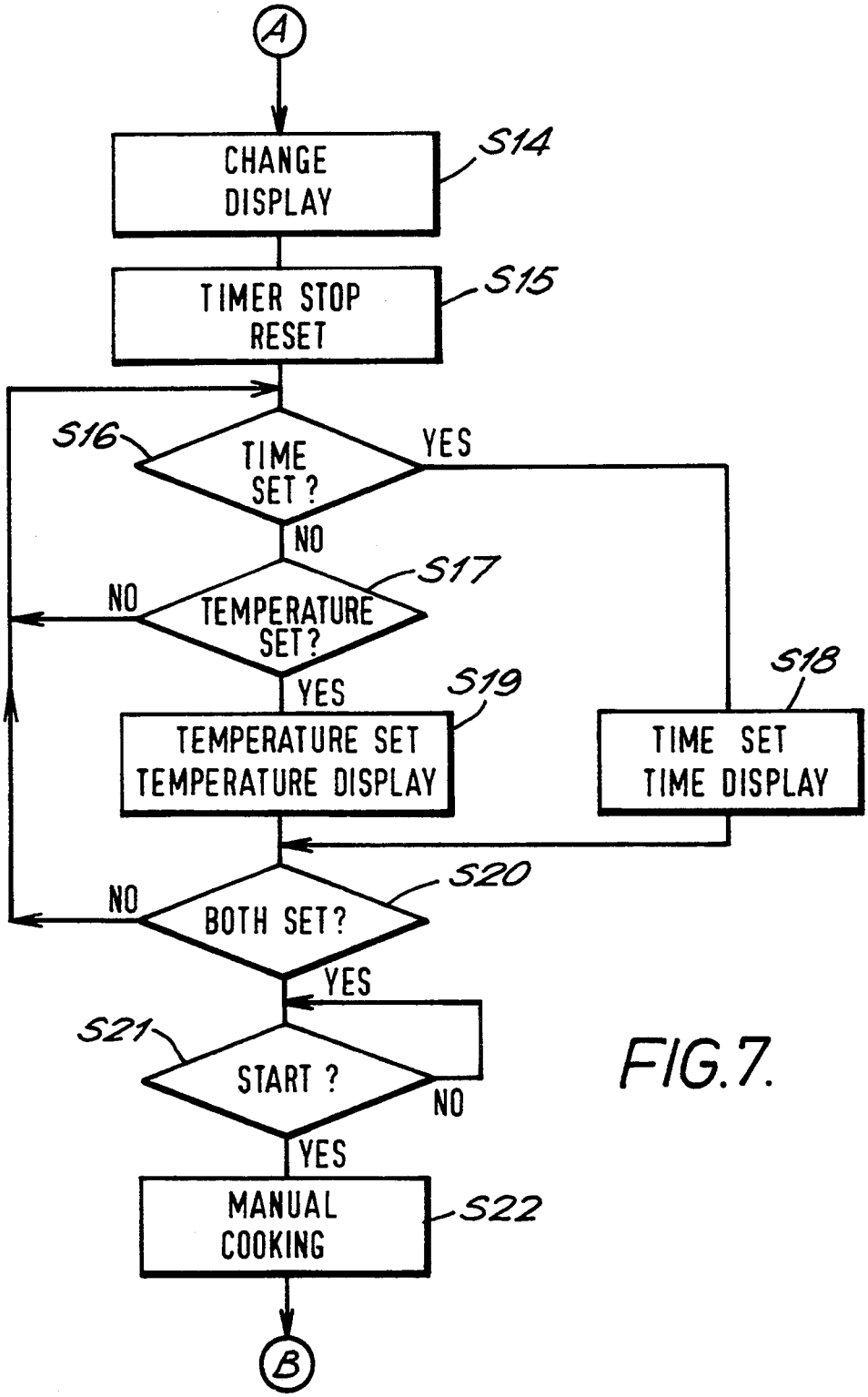

When step S11, determines that the user has pressed select switch 90 to manually control oven cooking or grilling, as illustrated in FIG. 7, display 84 is changed from "automatic cooking" to "manual cooking" (step S14). The timer stops counting and is reset and cleared (step S15). The user sets the cooking time and cooking temperature using time setting dial 92 and temperature setter 94. Microcomputer 96 determines whether time setting dial 92 is operated (step S16). If so, the cooking time is set and displayed on display 84. Flow progresses to step S20. Microcomputer 96 also determines whether temperature setter 94 is operated (step S17). If not, flow returns back to step S16. If so, the cooking temperature is set and displayed on display 84. Flow progresses to step S20 where microcomputer 96 determines whether both temperature and time have been set. If not, flow returns back to step S16. If so, microcomputer 96 determines whether start switch 86 has been pressed (step S21). If so, microcomputer 96 controls oven heater 30 or grill heater 34 to maintain the set temperature for the set time (step S22). After the cooking is completed, flow returns back to step S2.

When food and/or an attachment is temporarily placed within cooking compartment 14 with no intention to cook, the user does not operate start switch 86 or select switch 90. After door 16 has been closed, microcomputer 96 remains in a standby mode for ten seconds (steps S9 to S11). Thereupon, the result become "yes" at step S9 and microcomputer 96 leaves the standby mode. As a result, if start switch 86 is pressed by accident, microwave oven 10 does not start cooking automatically.

After microcomputer 96 leaves the standby mode, if cancel switch 88 is pressed during a period of 15 seconds (step S27), flow returns back to step S8. Microcomputer 96 resumes the standby mode and waits up to 10 seconds for the user to press start switch 86 or select switch 90. If start switch 86 or select switch 90 is operated while in standby mode, microwave oven 10 starts cooking automatically or manually.

That is, once cancel switch 88 is operated within 15 seconds of leaving the standby mode, microcomputer 96 resumes the standby mode again. Therefore, if the user spends more than 10 seconds to operate start switch 86 or select switch 90 after door 16 is closed, the user can place microcomputer 96 back in the standby mode by pressing cancel switch 88 instead of opening door 16.

If, after the 15 seconds, the user has not pressed cancel switch 88, processing proceeds through steps S28, S2 and S3 to step S4 where processing waits until the user opens the door.

According to this embodiment, microcomputer 96 determines which attachments are in cooking compartment 14, and sets a specific cooking mode on the basis of this determination. Then microcomputer 96 enters a standby mode. If an operating switch, such as start switch 86 or select switch 90, is not pressed within ten seconds, but is pressed thereafter, microwave oven 10 will not start cooking.

Therefore, if food or anything else should be temporarily placed in cooking compartment 14 without any intention to activate the oven, even though start switch 86 is later accidentally pressed, the microwave oven does not start cooking.

Although only a single preferred embodiment has been described in detail above, those skilled in the art will readily understand that many modifications are possible in the preferred embodiment without departing from the teachings thereof.

All such modifications are intended to be encompassed within the following claims.

What is claimed is:

1. A cooking appliance, comprising:

a cooking compartment for receiving food and an attachment;

a door for accessing the cooking compartment;

means for receiving a start command to cause initiation of a new cooking cycle;

means for heating food received in the cooking compartment after said receiving means receives said start command;

first detecting means for detecting the state of the door;

second detecting means for detecting the attachment received in the cooking compartment;

means, responsive to the first and second detecting means, for setting a cooking mode based on the received attachment when the door is closed, and means for preventing initiation of said cooking cycle after a predetermined time elapses from the closing of the door prior to initiation of said cooking cycle without said start command being received by said receiving means to initiate said cooking cycle.

2. A cooking appliance according to claim 1, wherein the first detecting means includes a microswitch, by which the state of the door is determined to be open or closed.

3. A cooking appliance according to claim 1, wherein the setting means includes a memory in which the cooking mode is stored, the cooking mode being determined on the basis of data from the second detecting means.

4. A cooking appliance according to claim 1, further including a start switch for generating the start command, a memory storing a program, and means for controlling the heating means, wherein when the start switch is actuated before the predetermined time elapses, the controlling means automatically controls the heating means based on the program in the memory in accordance with a cooking mode.

5. A cooking appliance according to claim 1, wherein the setting and preventing means includes means for cancelling the set cooking mode.

6. A cooking appliance according to claim 5, wherein the setting and preventing means includes means for resuming the cancelling cooking mode when a cancel command is received.

7. A cooking appliance according to claim 1, wherein the setting and preventing means includes means for enabling cooking after the setting and preventing means prevents cooking when a cancel command is received.

8. A method of operating a cooking appliance, the cooking appliance having a cooking compartment, comprising the steps of:

detecting that a door of the cooking compartment is closed;

detecting an attachment in the cooking compartment;

setting a cooking mode in accordance with the attachment detected; and preventing initiation of said cooking cycle after a predetermined time elapses from the closing of the door prior to initiation of said cooking cycle without a start command being received to initiate said cooking cycle.

9. A method of operating a cooking appliance according to claim 8, further comprising the step of enabling cooking after the preventing step prevents cooking when a cancel command is received within another predetermined time.

10. A method of operating a cooking appliance according to claim 8, wherein the preventing step includes the step of cancelling the set cooking mode.

11. A method of operating a cooking appliance according to claim 10, further comprising the step of resuming the cancelled cooking mode for an additional period when a cancel command is received within another predetermined time.

* * * * *